US011306419B2

(12) United States Patent
Song

(10) Patent No.: US 11,306,419 B2
(45) Date of Patent: Apr. 19, 2022

(54) WOVEN FABRIC

(71) Applicant: Dongguan Shichang Metals Factory Ltd., DongGuan (CN)

(72) Inventor: Guo Qiang Song, Hangzhou (CN)

(73) Assignee: Dongguan Shichang Metals Factory Ltd., DongGuan (CN)

( * ) Notice: Subject to any disclaimer, the term of this patent is extended or adjusted under 35 U.S.C. 154(b) by 259 days.

(21) Appl. No.: 16/804,405

(22) Filed: Feb. 28, 2020

(65) Prior Publication Data

US 2021/0148016 A1 May 20, 2021

Related U.S. Application Data

(63) Continuation-in-part of application No. 29/713,603, filed on Nov. 18, 2019.

(30) Foreign Application Priority Data

Dec. 17, 2019 (CN) ..... 201922286511.5

(51) Int. Cl.

| | |
|---|---|
| ***D03D 15/54*** | (2021.01) |
| ***D06N 3/00*** | (2006.01) |
| ***D06P 3/52*** | (2006.01) |

(52) U.S. Cl.

CPC ..... *D03D 15/54* (2021.01); *D06N 3/0006* (2013.01); *D06N 3/007* (2013.01); *D06N 3/0036* (2013.01); *D06N 3/0043* (2013.01); *D06P 3/522* (2013.01); *D06N 2205/04* (2013.01); *D06N 2209/0823* (2013.01); *D10B 2331/04* (2013.01); *D10B 2401/14* (2013.01)

(58) Field of Classification Search

None

See application file for complete search history.

(56) References Cited

U.S. PATENT DOCUMENTS

| | | | |
|---|---|---|---|
| D9,424 | S | 8/1876 | Einstein |
| D9,425 | S | 8/1876 | Einstein |
| D10,136 | S | 7/1877 | Perry |
| 1,224,650 | A | 5/1917 | Kitchen |
| D58,860 | S | 8/1921 | Worms |
| D88,773 | S | 12/1932 | Gottesman |

(Continued)

FOREIGN PATENT DOCUMENTS

| | | | |
|---|---|---|---|
| CN | 30080226 | S | 7/2008 |
| CN | 202730383 | U | 2/2013 |

(Continued)

*Primary Examiner* — Arti Singh-Pandey

(74) *Attorney, Agent, or Firm* — Luedeka Neely Group, P.C.

(57) ABSTRACT

A comfortable fabric with a strong three-dimensional effect is woven from warps and wefts. The warps and the wefts are woven into a 1/1 pattern, wherein the warp density is 11 threads/cm and the weft density is 10 threads/cm. The warps and the wefts each include a cationic dyeable polyester hollow yarn that comprises two different polyester yarns which can be dyed with two different colors. The warps and wefts comprise big-belly yarns and the cationic dyeable polyester hollow yarns. The resulting fabric has protruding patterns, a strong three-dimensional effect, good air permeability, a rough feel to the touch, and a unique aesthetic appearance.

11 Claims, 2 Drawing Sheets

(56) References Cited

U.S. PATENT DOCUMENTS

| | | | |
|---|---|---|---|
| D95,907 | S | 6/1935 | Greenawalt |
| D97,046 | S | 10/1935 | Forstmann |
| D98,992 | S | 3/1936 | Beniston |
| D101,820 | S | 11/1936 | Perkins |
| D107,651 | S | 12/1937 | Klein |
| D112,556 | S | 12/1938 | Weisberger |
| D113,096 | S | 1/1939 | Staines |
| D116,675 | S | 9/1939 | Walther |
| D116,735 | S | 9/1939 | Bry |
| D117,410 | S | 10/1939 | Wershing |
| D117,548 | S | 11/1939 | Feldman |
| D121,578 | S | 7/1940 | Sokolofl |
| D123,964 | S | 12/1940 | Sumerfield |
| 2,253,374 | A | 8/1941 | Haskell |
| D133,938 | S | 9/1942 | Lord |
| D150,253 | S | 7/1948 | Redman |
| D161,221 | S | 12/1950 | Walther |
| 2,574,375 | A | 11/1951 | Dave |
| 2,878,553 | A | 3/1959 | Hirsch |
| 3,485,706 | A | 12/1969 | Evans |
| 3,655,501 | A | 4/1972 | Tesch |
| 3,788,365 | A | 1/1974 | Campbell et al. |
| 3,922,888 | A | 12/1975 | Patterson |
| 4,142,334 | A | 3/1979 | Kirsch et al. |
| D261,187 | S | 10/1981 | Stocker |
| 4,342,802 | A | 8/1982 | Pickens, Jr. et al. |
| D287,433 | S | 12/1986 | Ellers |
| 4,671,983 | A | 6/1987 | Burt |
| 5,258,217 | A | 11/1993 | Lewis |
| D341,944 | S | 12/1993 | Peter |
| 5,290,456 | A | 3/1994 | Losack |
| 5,458,950 | A | 10/1995 | Bredenick et al. |
| 5,487,936 | A | 1/1996 | Collier |
| D367,766 | S | 3/1996 | Makoui et al. |
| 5,554,424 | A | 9/1996 | Krummheuer et al. |
| 5,707,903 | A | 1/1998 | Schottenfeld |
| 5,913,765 | A | 6/1999 | Burgess et al. |
| D419,783 | S | 2/2000 | Tavenas |
| D428,267 | S | 7/2000 | Romano et al. |
| 6,136,413 | A | 10/2000 | Port et al. |
| 6,153,545 | A | 11/2000 | Lalonde et al. |
| D438,355 | S | 2/2001 | Tintelnot |
| 6,251,207 | B1 | 6/2001 | Schultz et al. |
| D465,337 | S | 11/2002 | Curtis et al. |
| D490,988 | S | 6/2004 | Delaney et al. |
| D511,251 | S | 11/2005 | Wong |
| D522,252 | S | 6/2006 | Harkenrider |
| D522,254 | S | 6/2006 | Harkenrider |
| 7,108,020 | B2 | 9/2006 | Stone |
| D530,101 | S | 10/2006 | Harkenrider |
| D533,725 | S | 12/2006 | Harkenrider |
| 7,169,458 | B2 | 1/2007 | Underhill et al. |
| D536,877 | S | 2/2007 | Harkenrider |
| D536,879 | S | 2/2007 | Harkenrider |
| D597,319 | S | 8/2009 | Harkenrider |
| D618,526 | S | 6/2010 | Denicola |
| 7,740,928 | B2 | 6/2010 | Mehta et al. |
| 8,329,283 | B2 | 12/2012 | Takagi et al. |
| 8,722,553 | B2 | 5/2014 | Johansson |
| D707,974 | S | 7/2014 | Blackford |
| D711,121 | S | 8/2014 | Svendsen et al. |
| D715,064 | S | 10/2014 | Han |
| D770,188 | S | 11/2016 | Fang |
| D775,473 | S | 1/2017 | Cheung |
| D783,294 | S | 4/2017 | Ellis et al. |
| D789,097 | S | 6/2017 | Bouroullec et al. |
| D802,940 | S | 11/2017 | Bouroullec et al. |
| D834,838 | S | 12/2018 | Roldan-Posada et al. |
| 10,145,035 | B2 | 12/2018 | Goldberg |
| 10,252,690 | B2 | 4/2019 | Seo et al. |
| 10,279,771 | B2 | 5/2019 | Westoby |
| D851,944 | S | 6/2019 | Toelke et al. |
| D858,040 | S | 9/2019 | Reynolds |
| 10,435,827 | B2 | 10/2019 | Endle et al. |
| D878,296 | S | 3/2020 | Miller et al. |
| D880,873 | S | 4/2020 | Qiang |
| 10,655,248 | B2 | 5/2020 | Youn et al. |
| 10,688,956 | B2 | 6/2020 | Harabayashi |
| 10,697,095 | B2 | 6/2020 | Qiang |
| 2001/0049243 | A1 | 12/2001 | Crouch et al. |
| 2002/0034914 | A1 | 3/2002 | Leon et al. |
| 2002/0094404 | A1 | 7/2002 | Schottenfeld |
| 2002/0132714 | A1 | 9/2002 | Carter et al. |
| 2003/0118777 | A1 | 6/2003 | Chang et al. |
| 2004/0200590 | A1 | 10/2004 | Wilhelm |
| 2004/0238063 | A1 | 12/2004 | Stone |
| 2012/0015155 | A1 | 1/2012 | Blackford et al. |
| 2012/0208416 | A1 | 8/2012 | Lerman |
| 2013/0209749 | A1 | 8/2013 | Myangiro et al. |
| 2013/0247268 | A1* | 9/2013 | Niwa ..... D03D 11/02 2/67 |
| 2015/0140240 | A1 | 5/2015 | Pleyber et al. |
| 2017/0086615 | A1 | 3/2017 | Alanen |
| 2018/0363171 | A1 | 12/2018 | Naruko et al. |
| 2020/0002852 | A1 | 1/2020 | Qiang |
| 2020/0197764 | A1 | 6/2020 | Greaney et al. |

FOREIGN PATENT DOCUMENTS

| | | | |
|---|---|---|---|
| CN | 103361847 | A | 10/2013 |
| CN | 103668708 | A | 3/2014 |
| CN | 104248100 | A | 12/2014 |
| CN | 303026159 | | 12/2014 |
| CN | 303046618 | S | 12/2014 |
| CN | 303432528 | S | 11/2015 |
| CN | 303472812 | S | 12/2015 |
| CN | 303556316 | S | 1/2016 |
| CN | 105666986 | A | 6/2016 |
| CN | 303866329 | S | 9/2016 |
| CN | 304068580 | S | 3/2017 |
| CN | 108286193 | A | 7/2018 |
| CN | 304774405 | S | 8/2018 |
| CN | 304965232 | S | 12/2018 |
| GB | 1034651 | A | 6/1966 |
| GB | 6175596 | | 11/2021 |
| WO | 2015128883 | A2 | 9/2015 |

* cited by examiner

WOVEN FABRIC

RELATED APPLICATIONS

This application claims priority as a continuation-in-part to U.S. design patent application No. 29/713,603, titled Woven Fabric, filed Nov. 18, 2019. This application also claims priority to pending Chinese utility model application number 2019222865115, filed Dec. 17, 2019.

FIELD

This invention relates to the field of textile fabrics, and in particular, to a comfortable fabric with a strong three-dimensional visual effect.

BACKGROUND

At present, most of the fabrics applied to automobile seats, furniture seats, and the like are made of flax. Although flax fabrics have a soft and concavo-convex feel to the touch, they wrinkle and deform easily, and even tear when exposed to friction. In addition, the flax fabrics have a poor dyeing effect and their colors are not bright and rich enough to meet the aesthetic effect required by users.

What is needed, therefore, is a fabric for use in seats having a strong three-dimensional visual effect, good air permeability, a rough feel to the touch, and a fancy aesthetic visual effect.

SUMMARY

In view of the disadvantages of the prior art, an objective of the present disclosure is to provide a fabric with strong three-dimensional effect, good air permeability, a rough feel, and a unique appearance, structure and texture, resulting from various processing methods.

In order to achieve the foregoing objective, the technical solution adopted by the present disclosure is to provide a comfortable fabric with a strong three-dimensional visual effect. A preferred embodiment of the fabric is formed from warps and wefts that are woven into a 1/1 pattern, in which the warp density is 11 threads/cm and the weft density is 10 threads/cm. The warps and the wefts each include a cationic dyeable polyester hollow yarn comprising two different polyester yarns that can be dyed with two different colors.

In some embodiments, the weight of the fabric is 205 grams per square meter.

In some embodiments, the warps comprise 780 D cationic dyeable polyester hollow yarn, where polyester accounts for 100%.

In some embodiments, the wefts comprise 780 D cationic dyeable polyester hollow yarn and big-belly yarn, where polyester accounts for 100%.

In some embodiments, a back surface of the fabric is provided with a needle punch foam stabilizing coating.

A preferred embodiment of the fabric has the following beneficial effects:

The warps of the fabric comprise cationic dyeable polyester hollow yarn, and the wefts comprise big-belly yarn and the cationic dyeable polyester hollow yarn;

The big-belly yarn provides protruding patterns, a strong three-dimensional effect, good air permeability, a rough feel, and a unique structural appearance;

The cationic dyeable polyester hollow yarn has a concavo-convex feel and a soft feel of natural flax, a natural appearance of irregular surface wool top particles, bamboo joints, and the like, and overcome the wrinkling of natural flax; and The fabric comprises two different polyester yarn raw materials, and has rich color effects.

BRIEF DESCRIPTION OF THE DRAWINGS

Other embodiments of the invention will become apparent by reference to the detailed description in conjunction with the figures, wherein elements are not to scale so as to more clearly show the details, wherein like reference numbers indicate like elements throughout the several views, and wherein.

DETAILED DESCRIPTION

The present disclosure is further described in detail with reference to the accompanying drawings.

The specific embodiments described herein are only examples, and are not intended to limit the present disclosure. After reading this specification, a person skilled in the art may make modifications to the embodiments as required, but the modifications are protected by the patent law provided that they fall within the protection scope of the present disclosure.

As shown in the figures, embodiments of the present disclosure provide a comfortable fabric with a strong three-dimensional visual effect. The fabric is woven from warps 1 and wefts 2 in a 1/1 pattern, wherein the warps 1 run vertically and the wefts run horizontally in the figures. In a preferred embodiment, the density of the warps 1 of the fabric is 11 threads/cm and the density of the wefts 2 of the fabric is 10 threads/cm. The warps 1 and the wefts 2 include a cationic dyeable polyester hollow yarn 1*a*, and the cationic dyeable polyester hollow yarn 1*a* comprises two different polyester yarns that can be dyed with two different colors.

Figure 1:
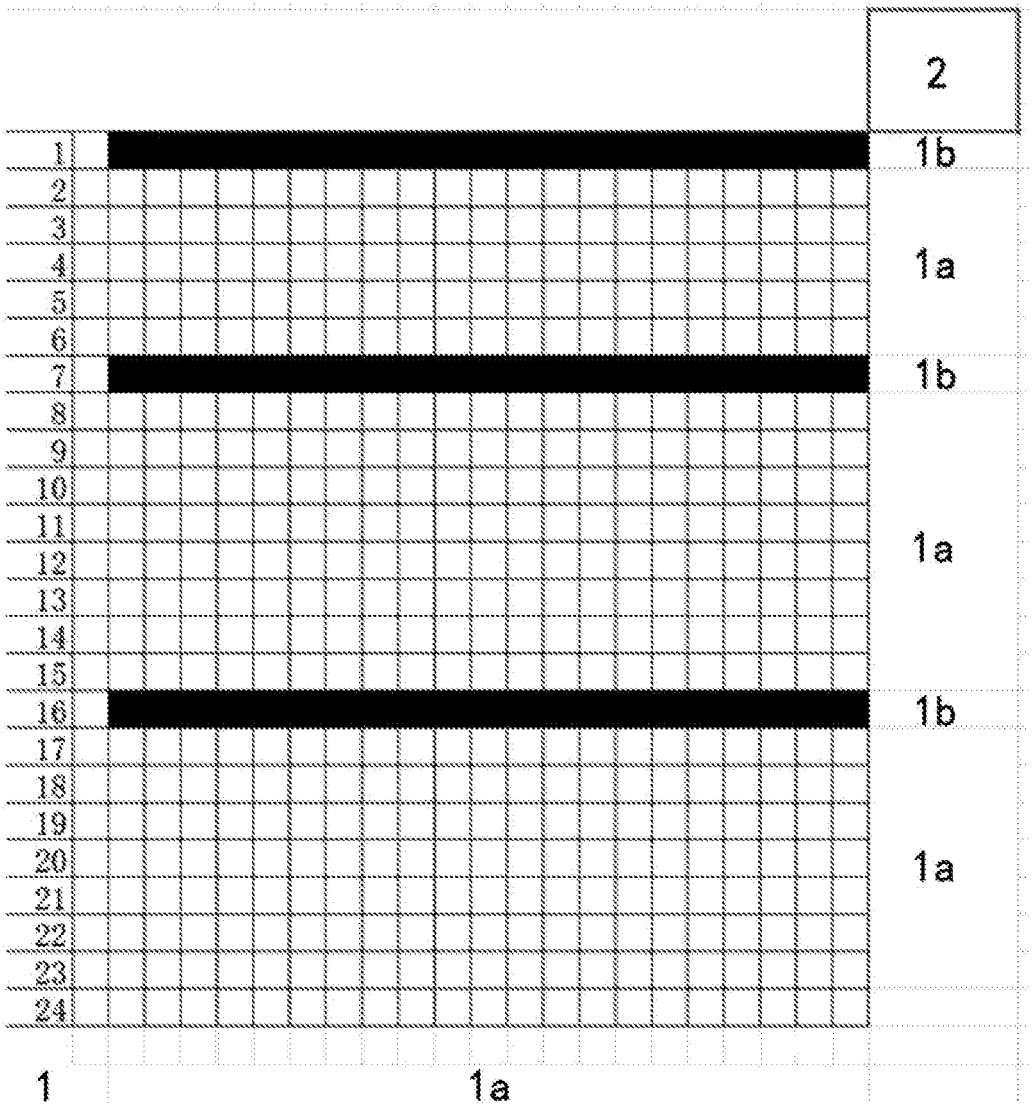
FIG. 1 depicts a yarn weave diagram of a fabric according to an embodiment of the invention.
Figure 2:
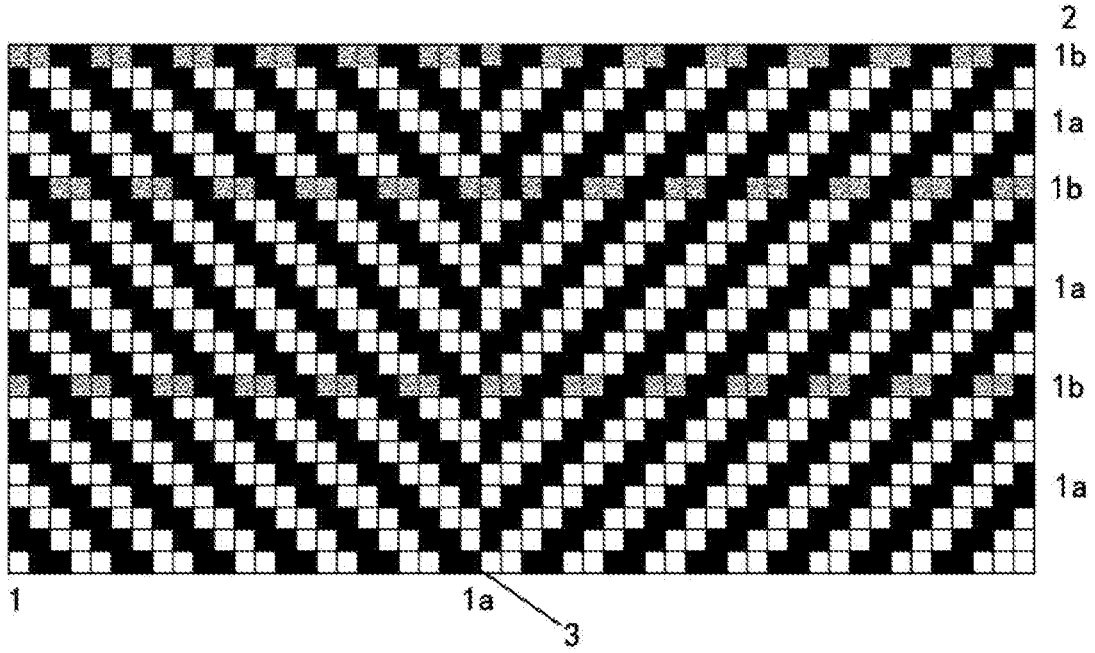
FIG. 2 depicts a weave diagram of the fabric according to an embodiment of the invention.

In a preferred embodiment, the weight of the fabric is 205 grams per square meter. The warps 1 preferably comprise 780 D cationic dyeable polyester hollow yarns 1*a*, where polyester accounts for 100%. The wefts 2 preferably comprise 780 D cationic dyeable polyester hollow yarns 1*a* and big-belly yarn 1*b*, where polyester accounts for 100%. The fabric woven using the big-belly yarn 1*b* (with contrasting color) has protruding patterns, strong three-dimensional visual effect, good air permeability, a rough feel to the touch, and a unique appearance. The cationic dyeable polyester hollow yarns 1*a* are produced using a special processing technology that provides a concavo-convex feel and soft feel of natural flax, but which overcomes the wrinkling of the natural flax. This processing technology provides a natural appearance of irregular surface wool top particles, bamboo joints, and the like. The cationic dyeable polyester yarns 1*a* preferably comprises two different polyester yarn raw materials. The modified polyester fiber, which is dyed differently than an ordinary polyester fiber, can have a two-color effect, and its colors are brighter and richer. A vertical column in FIG. 2 shows a pattern 3 of the fabric.

Figure 3:
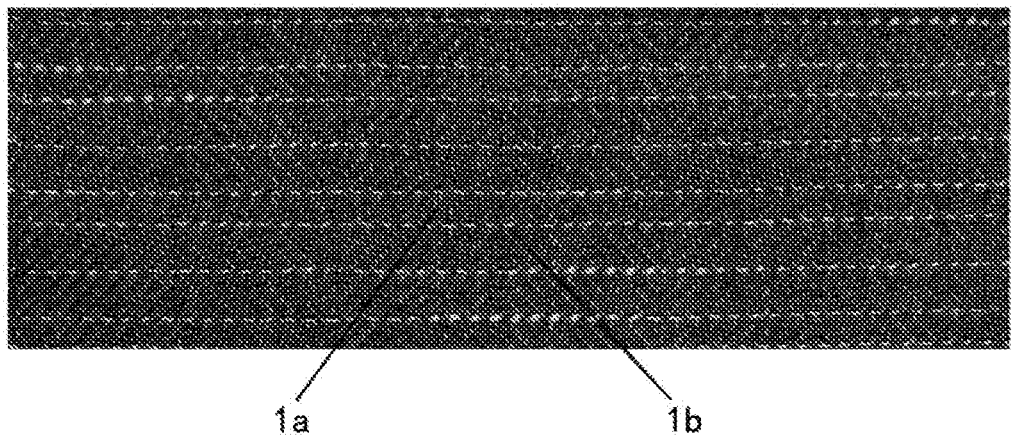
FIG. 3 depicts an overall schematic diagram of the fabric according to an embodiment of the invention.

As shown in FIG. 3, the cationic dyeable polyester hollow yarns 1*a* are used as the warps 1 of the fabric. In a preferred embodiment, the cationic dyeable polyester hollow yarns 1*a* and nine big-belly yarns 1*b* are used as the wefts 2 within a unit area, where the thickness of the big belly yarn 1*b* changes like waves. The combined advantages of the cationic dyeable polyester hollow yarns 1*a* and the big-belly yarns 1*b* provide the concavo-convex touch and soft touch of the fabric, and rich colors.

In some embodiments, the back surface of the fabric is provided with a needle punch foam stabilizing coating, which further protects the fabric, makes the fabric firmer, and improves the strength of the fabric.

In addition, the warps 1 and the wefts 2 of some embodiments of the fabric are colored at high temperature, and have higher color fastness compared with common cotton and linen fabrics.

The foregoing description of preferred embodiments for this invention have been presented for purposes of illustration and description. They are not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fabric comprising warps and wefts that are woven into a 1/1 pattern having a warp density of 11 threads/cm and a weft density of 10 threads/cm, wherein the warps and the wefts each comprise a cationic dyeable polyester hollow yarn, and the cationic dyeable polyester hollow yarn comprises two different polyester yarns that are dyed with two different colors.

2. The fabric of claim 1 having a weight of 205 grams per square meter.

3. The fabric of claim 1, wherein the warps comprise 780 D cationic dyeable polyester hollow yarns, wherein polyester accounts for 100%.

4. The fabric of claim 2, wherein the warps comprise 780 D cationic dyeable polyester hollow yarns, wherein polyester accounts for 100%.

5. The fabric of claim 1, wherein the wefts comprise 780 D cationic dyeable polyester hollow yarns and big-belly yarns, wherein polyester accounts for 100%.

6. The fabric of claim 2, wherein the wefts comprise 780 D cationic dyeable polyester hollow yarns and big-belly yarns, wherein polyester accounts for 100%.

7. The fabric of claim 1, further comprising a back surface having a needle punch foam stabilizing coating.

8. The fabric of claim 2, further comprising a back surface having a needle punch foam stabilizing coating.

9. A fabric comprising warps and wefts that are woven into a 1/1 pattern having a warp density of 11 threads/cm and a weft density of 10 threads/cm, wherein the warps comprise only cationic dyeable polyester hollow yarns, and wherein the wefts comprise a combination of the cationic dyeable polyester hollow yarns and one or more big-belly yarns.

10. The fabric of claim 9, wherein cationic dyeable polyester hollow yarns comprise a first yarn dyed with a first color and a second yarn dyed with a second color, wherein the first color is different from the second color.

11. The fabric of claim 9 having a weight of 205 grams per square meter.

* * * * *